US009284022B2

(12) United States Patent
Johnson

(10) Patent No.: US 9,284,022 B2
(45) Date of Patent: Mar. 15, 2016

(54) MOTORBOAT WITH WIND SHROUD

(71) Applicant: Keith Norman Johnson, Conway, SC (US)

(72) Inventor: Keith Norman Johnson, Conway, SC (US)

( * ) Notice: Subject to any disclaimer, the term of this patent is extended or adjusted under 35 U.S.C. 154(b) by 0 days.

(21) Appl. No.: 14/182,052

(22) Filed: Feb. 17, 2014

(65) Prior Publication Data

US 2014/0311399 A1 Oct. 23, 2014

Related U.S. Application Data

(60) Provisional application No. 61/805,392, filed on Mar. 26, 2013.

(51) Int. Cl.
*B63B 17/02* (2006.01)

(52) U.S. Cl.
CPC ..... *B63B 17/02* (2013.01)

(58) Field of Classification Search
CPC .. A41D 13/085; B63H 21/265; B63H 21/213; B62J 23/00
See application file for complete search history.

(56) References Cited

U.S. PATENT DOCUMENTS 1,333,872 A * 3/1920 Overton ..... 2/17
1,825,240 A * 9/1931 Miller ..... 440/63

* cited by examiner

*Primary Examiner* — Edwin Swinehart
(74) *Attorney, Agent, or Firm* — Moore & Van Allen PLLC; W. Kevin Ransom

(57) ABSTRACT

Embodiments of the invention are directed to a boat motor assembly which includes a boat motor with a housing that serves as the body or chassis of the boat motor; a handle, coupled to and extending at length from the housing and configured to be grasped by a user; and a shroud assembly, which includes a shroud extension coupled to the handle extending at length from the handle; and a shroud coupled to the shroud extension, wherein the shroud is spaced apart from the housing to allow access to the handle between the shroud and the housing.

19 Claims, 14 Drawing Sheets

MOTORBOAT WITH WIND SHROUD

CROSS REFERENCES TO OTHER RELATED APPLICATIONS

This application claims priority from and is a non-provisional patent application of U.S. Provisional Patent Application No. 61/805,392, filed on Mar. 26, 2013, and entitled "Motorboat with Wind Shroud," the contents of which are hereby incorporated by reference in their entirety.

BACKGROUND

When operating a motorboat under windy or hard weather conditions, there is a need to protect one's hand at the motorboat's tiller as best as possible.

BRIEF SUMMARY

In one aspect, the present invention is directed to a boat motor assembly that includes: a housing that includes a boat motor, a handle coupled to and extending at length from the housing and configured to be grasped by a user, and a shroud assembly. The shroud assembly typically includes a shroud extension and a shroud. The shroud extension is typically coupled to the handle. The shroud is typically coupled to the shroud extension and spaced apart from the housing so as to allow access to the handle between the shroud and the housing.

In some embodiments, the handle defines a width, the shroud extension defining a width of at least the width of the handle.

In some embodiments, the handle defines a proximal portion and a distal portion relative to the housing, and wherein the shroud extension is permanently coupled to the distal portion of the handle.

In some embodiments, the handle defines a proximal portion and a distal portion relative to the housing, and wherein the shroud extension is detachably coupled to the distal portion of the handle.

In some embodiments, the handle defines a proximal portion and a distal portion relative to the housing, and wherein the shroud extension is rotatably coupled to the distal portion of the handle.

In some embodiments, the shroud is a conic attachment from the shroud extension.

In some embodiments, the conic attachment defines a first perimeter and a second perimeter around the perimeter defined by the shroud extension.

In some embodiments, the second perimeter of the conic attachment is less than the first perimeter of the conic attachment.

In some embodiments, the shroud is permanently coupled to the shroud extension.

In some embodiments, the shroud is detachably coupled to the shroud extension.

In some embodiments, the shroud is retractable.

In some embodiments, the shroud assembly is retractable into a cavity defined by the handle.

In some embodiments, the shroud assembly is mechanized with a motor to retract into the cavity defined by the handle.

In some embodiments, the shroud is collapsible.

In some embodiments, the shroud is collapsible on the surface defined by the shroud extension.

In some embodiments, the shroud is mechanized with a motor to collapse on the surface of the shroud extension.

In some embodiments, the shroud defines a stiff surface formed from a rigid material.

In some embodiments, the shroud comprises a flexible surface formed from a flexible material.

In some embodiments, a boat motor assembly is provided. The assembly comprises: a boat motor; a housing defining a cavity, wherein the boat motor is positioned in the cavity, wherein the housing has a handle extending at length from the housing, the handle being configured to be grasped by a user. a shroud assembly comprising; a shroud extension, wherein the extension is detachably coupled to the handle and extends at length from the handle; and a shroud, wherein the shroud is coupled to the extension, wherein the shroud is spaced apart from the housing to allow access to the handle between the shroud and the housing, wherein the shroud comprises a conic attachment, the conic attachment defining a first perimeter and a second perimeter around the perimeter defined by the shroud extension, the second perimeter of the conic attachment being less than the first perimeter of the conic attachment, the shroud defining a stiff surface formed from a rigid material.

In some embodiments, a boat motor assembly is provided. The assembly comprises: a boat motor; a housing defining a cavity, wherein the boat motor is positioned in the cavity, wherein the housing has a handle extending at length from the housing, the handle being configured to be grasped by a user; and a shroud, wherein the shroud is detachably coupled to the handle, wherein the shroud is spaced apart from the housing to allow access to the handle between the shroud and the housing, wherein the shroud comprises a conic attachment, the conic attachment defines a first perimeter and a second perimeter around the perimeter defined by the shroud extension, the second perimeter of the conic attachment being less than the first perimeter of the conic attachment, the shroud defining a stiff surface formed from a rigid material.

BRIEF DESCRIPTION OF THE DRAWINGS

Figure 1:
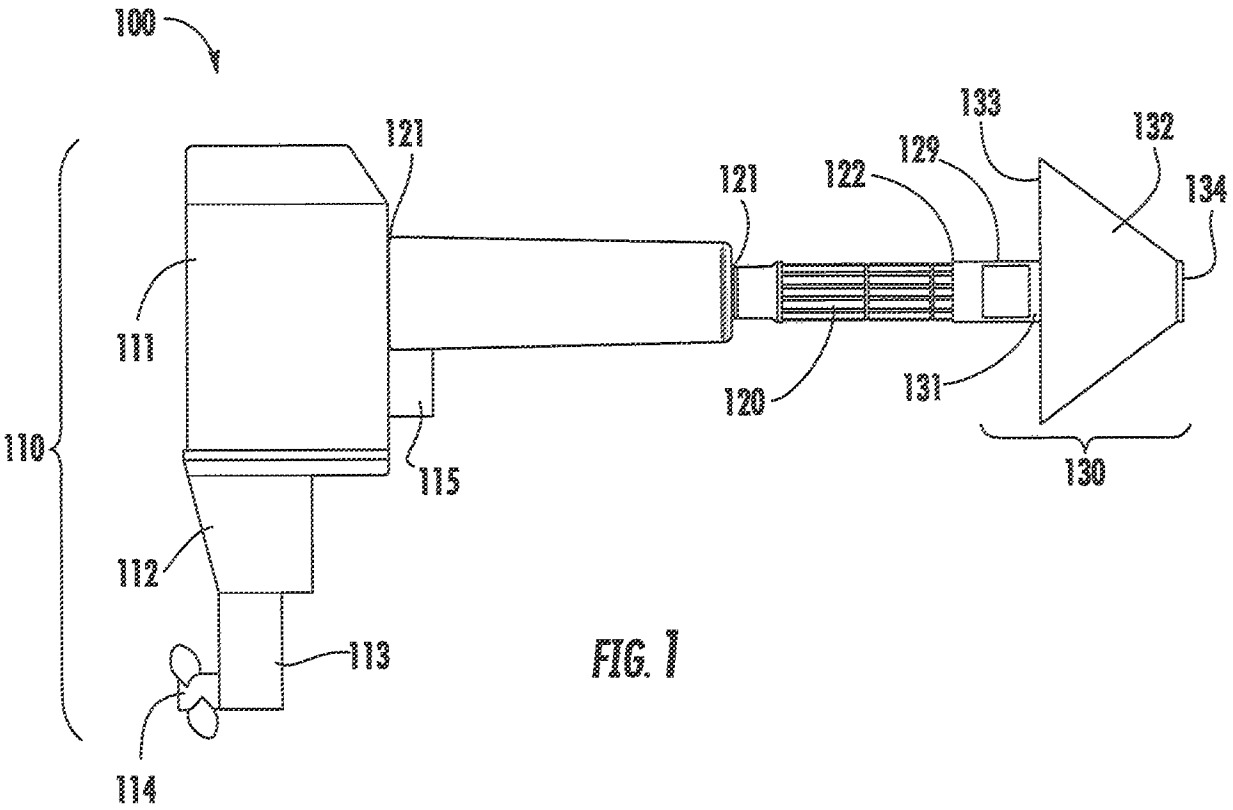
Figure 2:
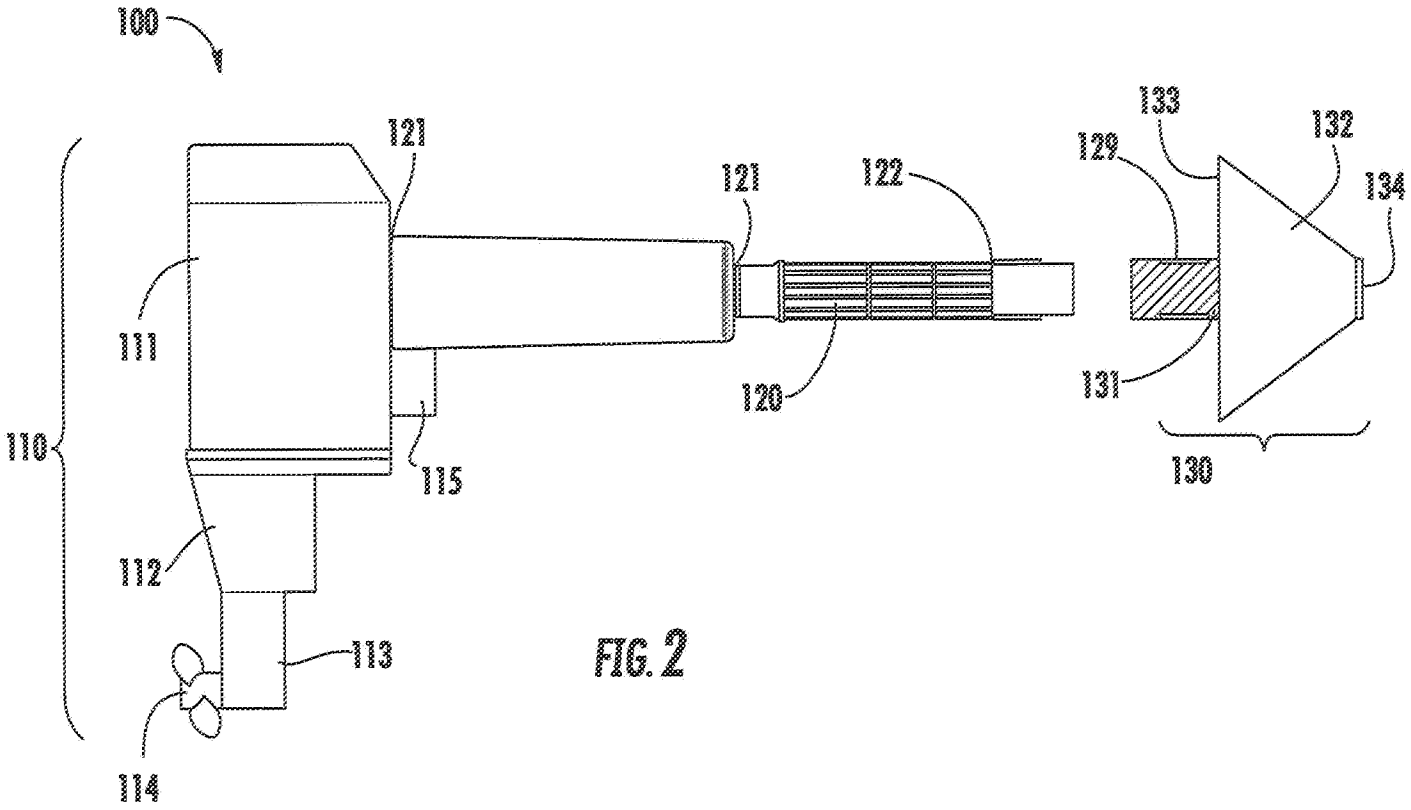
Figure 3:
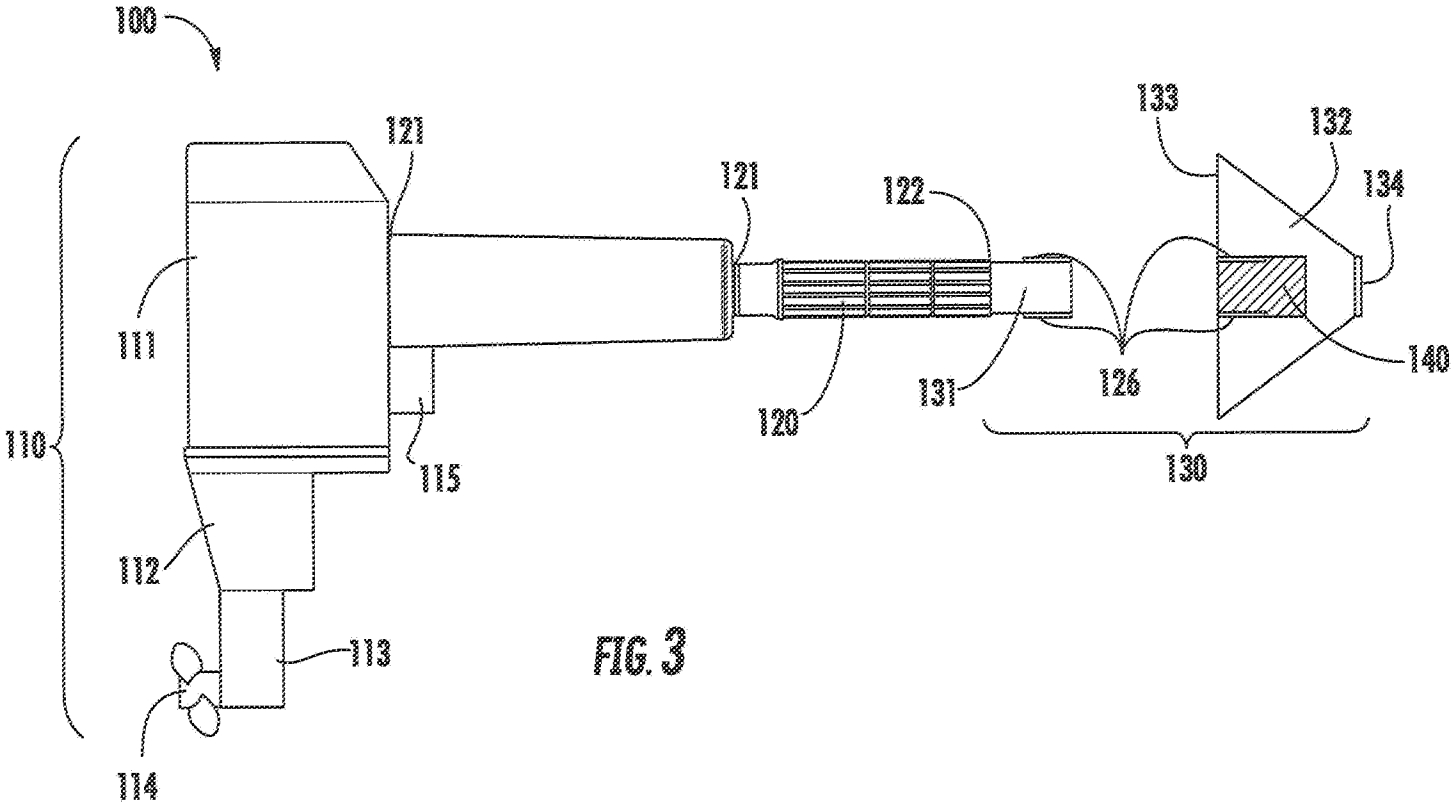
Figure 4:
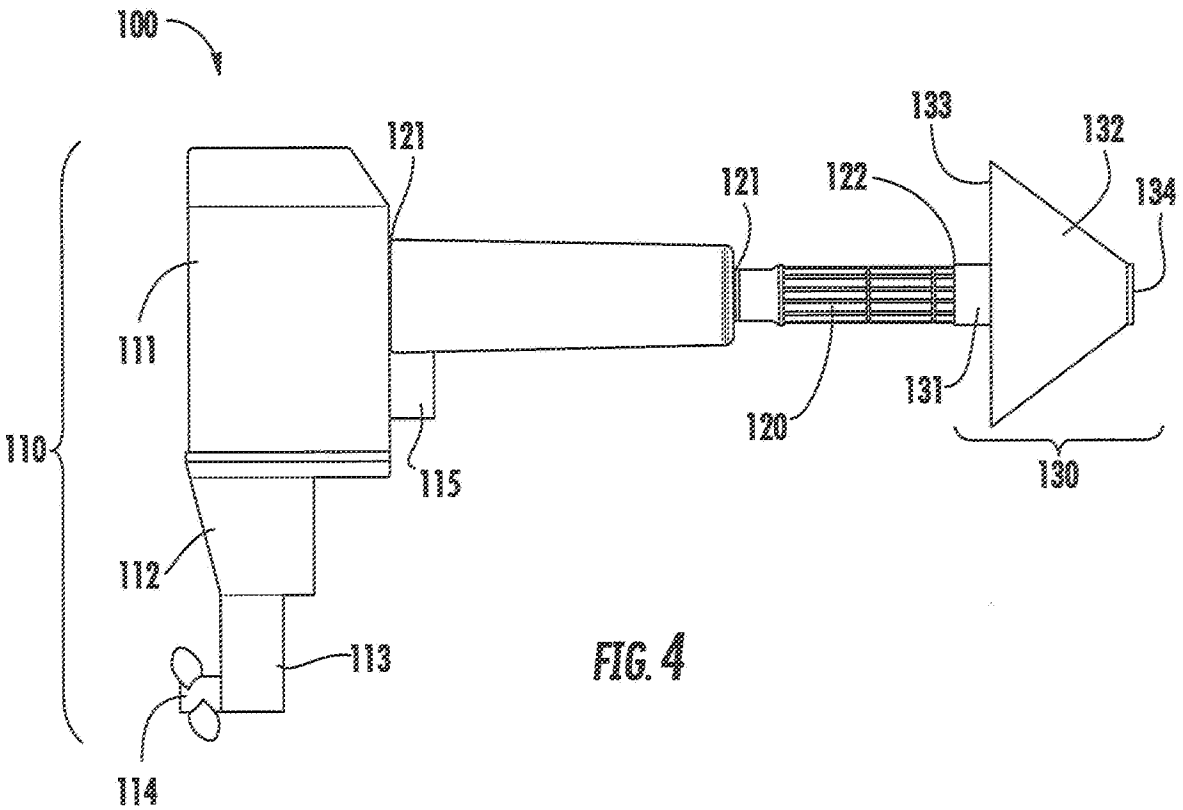
Figure 5:
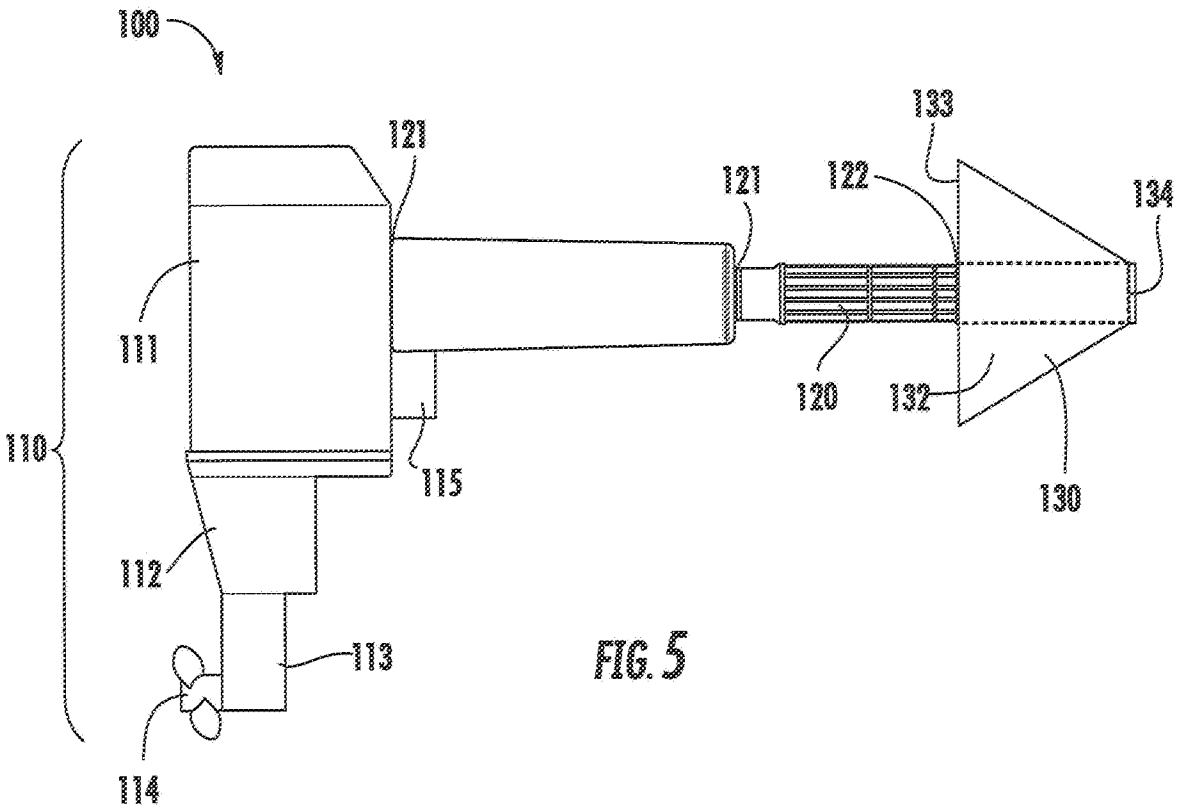
Figure 6:
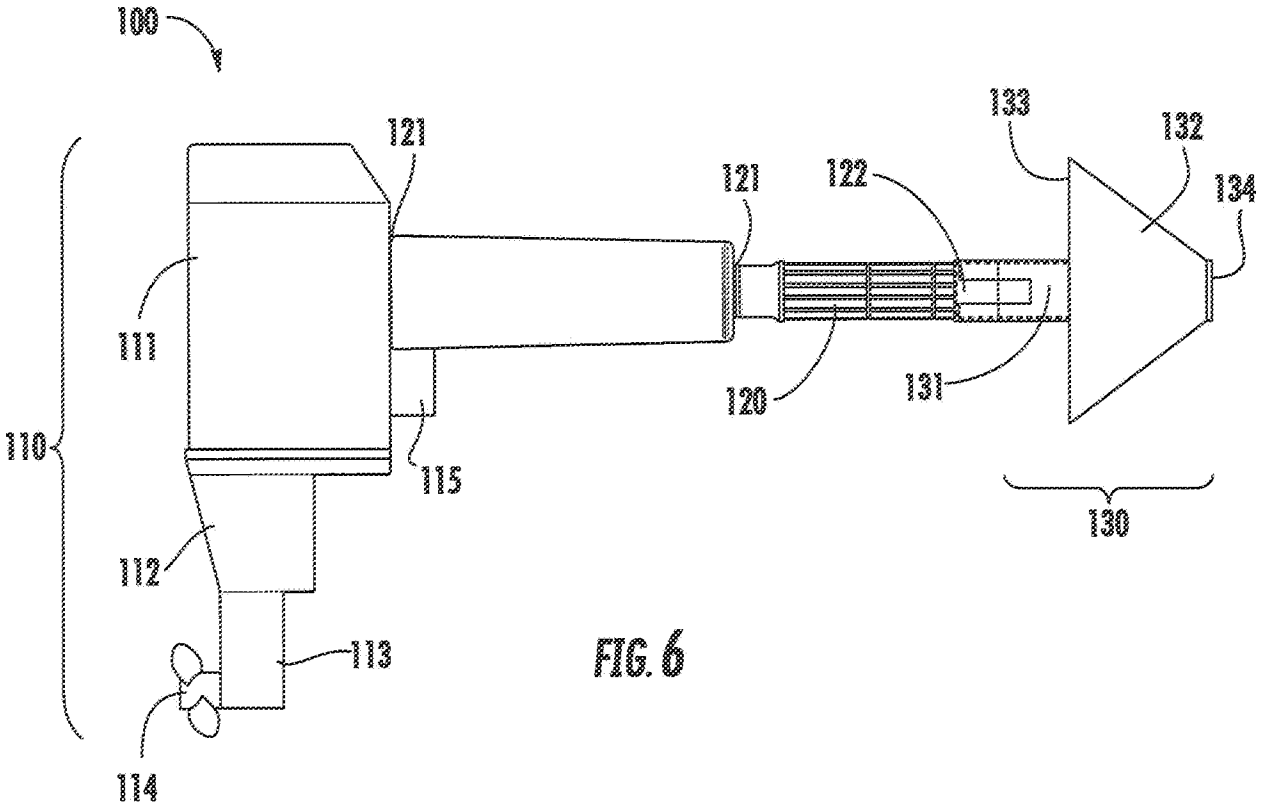
Figure 7:
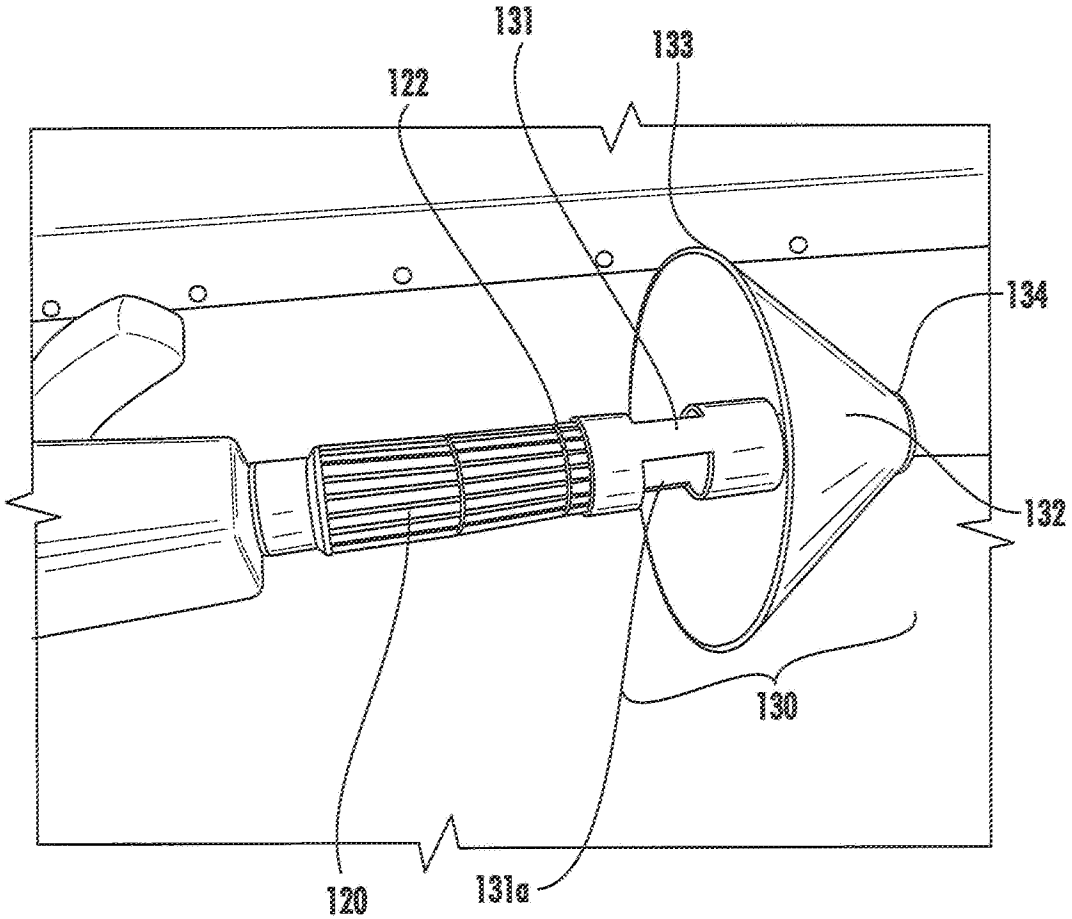
Figure 8:
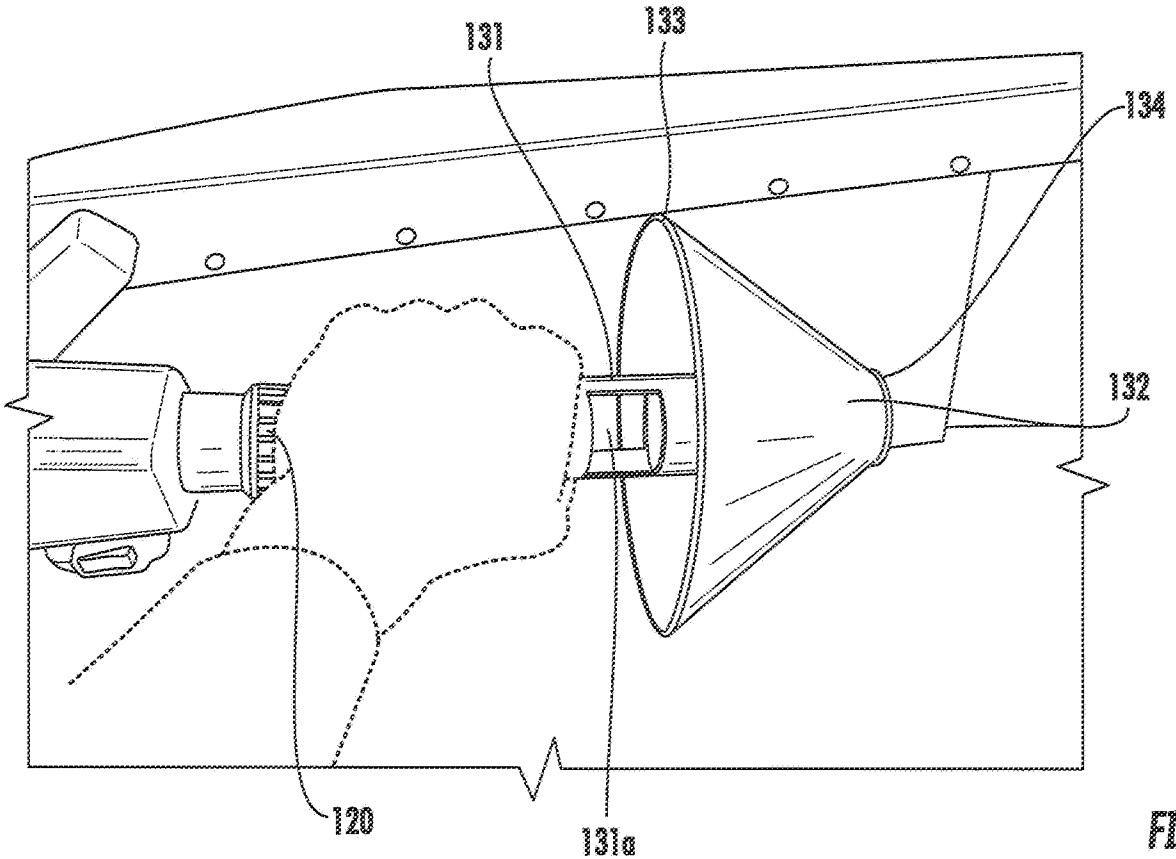
Figure 9:
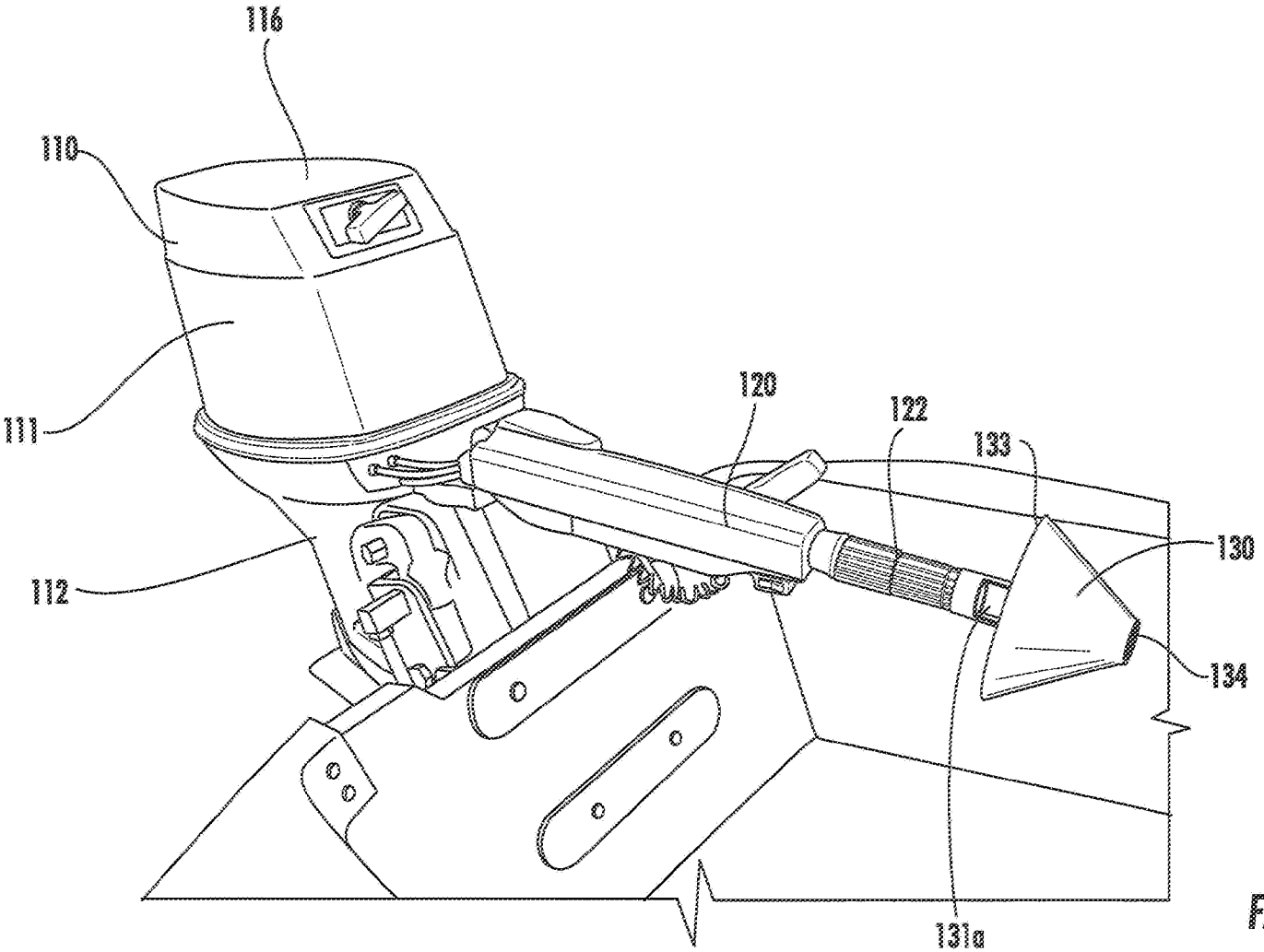
Figure 10:
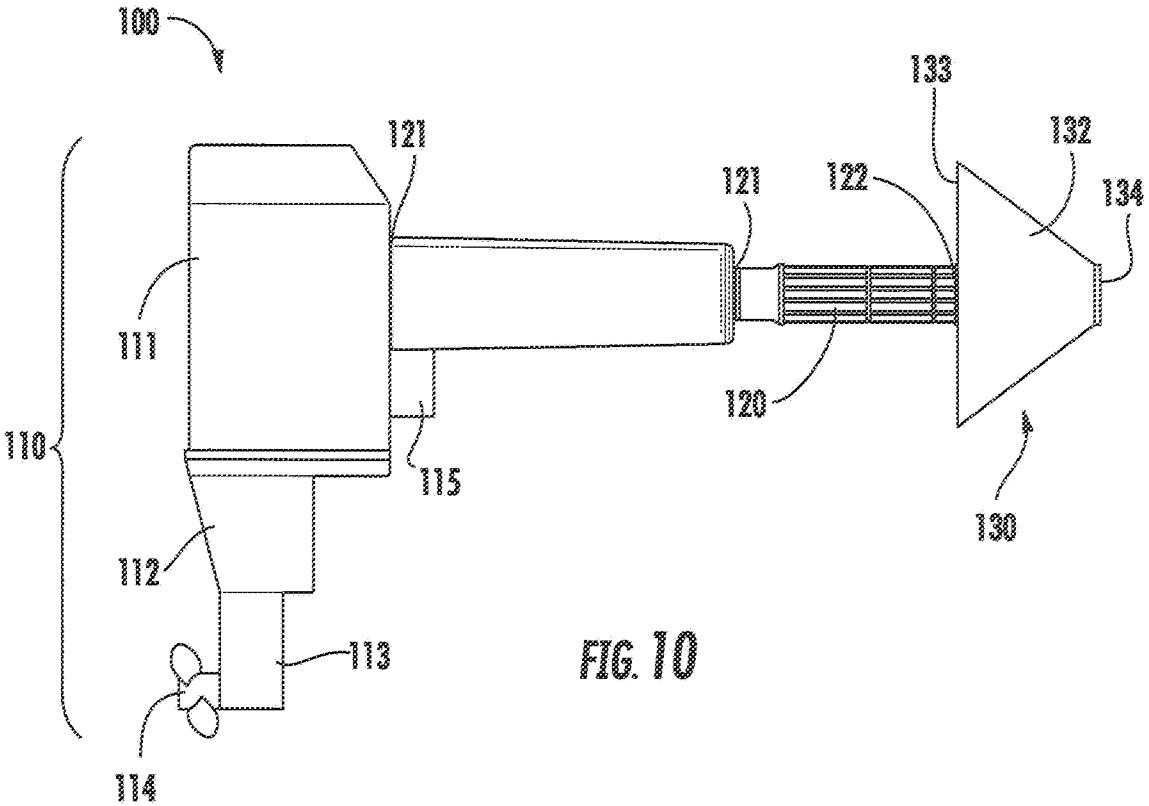
Figure 11:
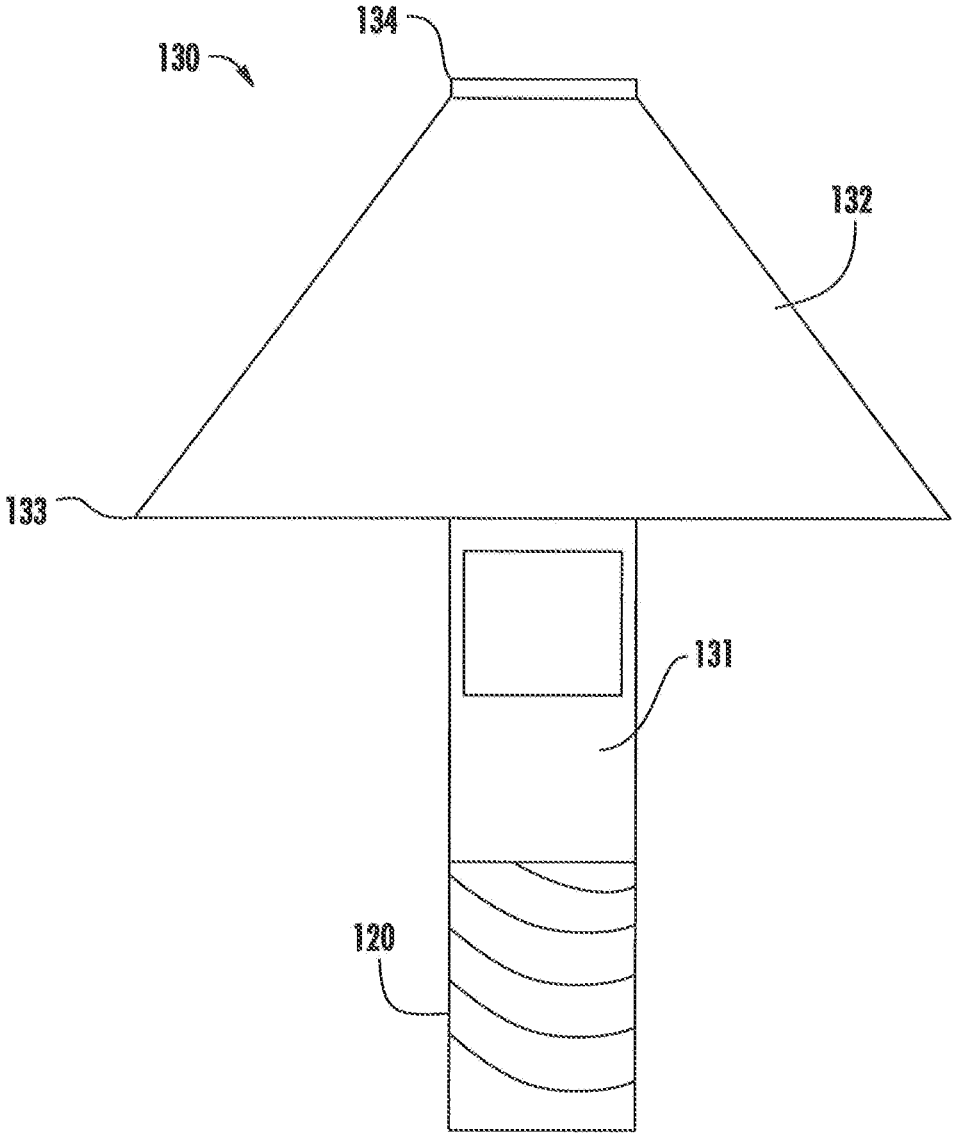
Figure 12:
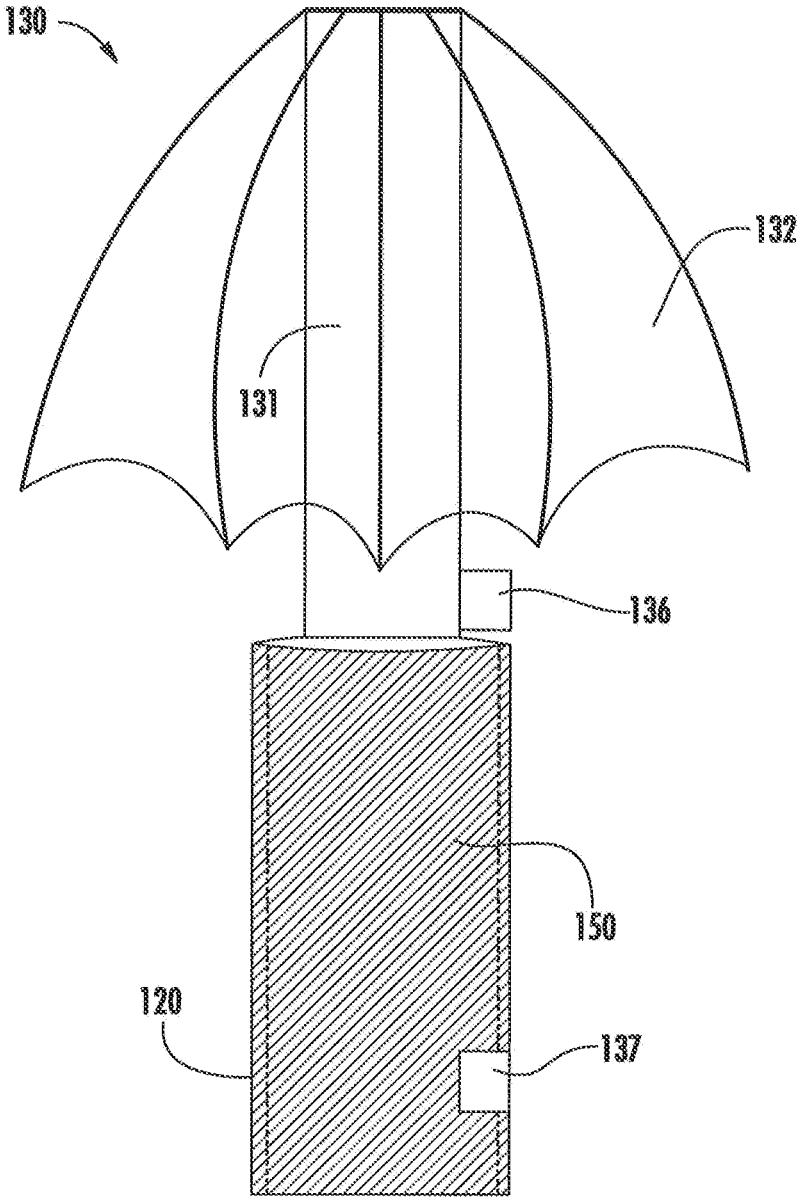
Figure 13:
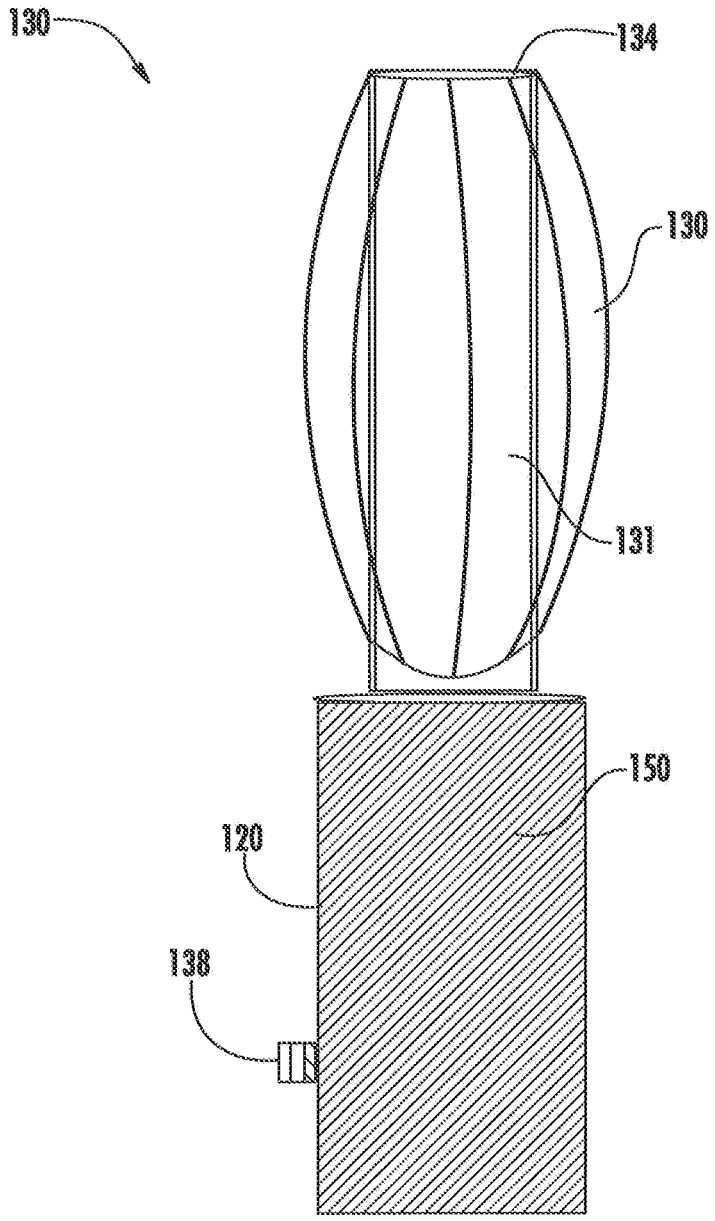
Figure 14:
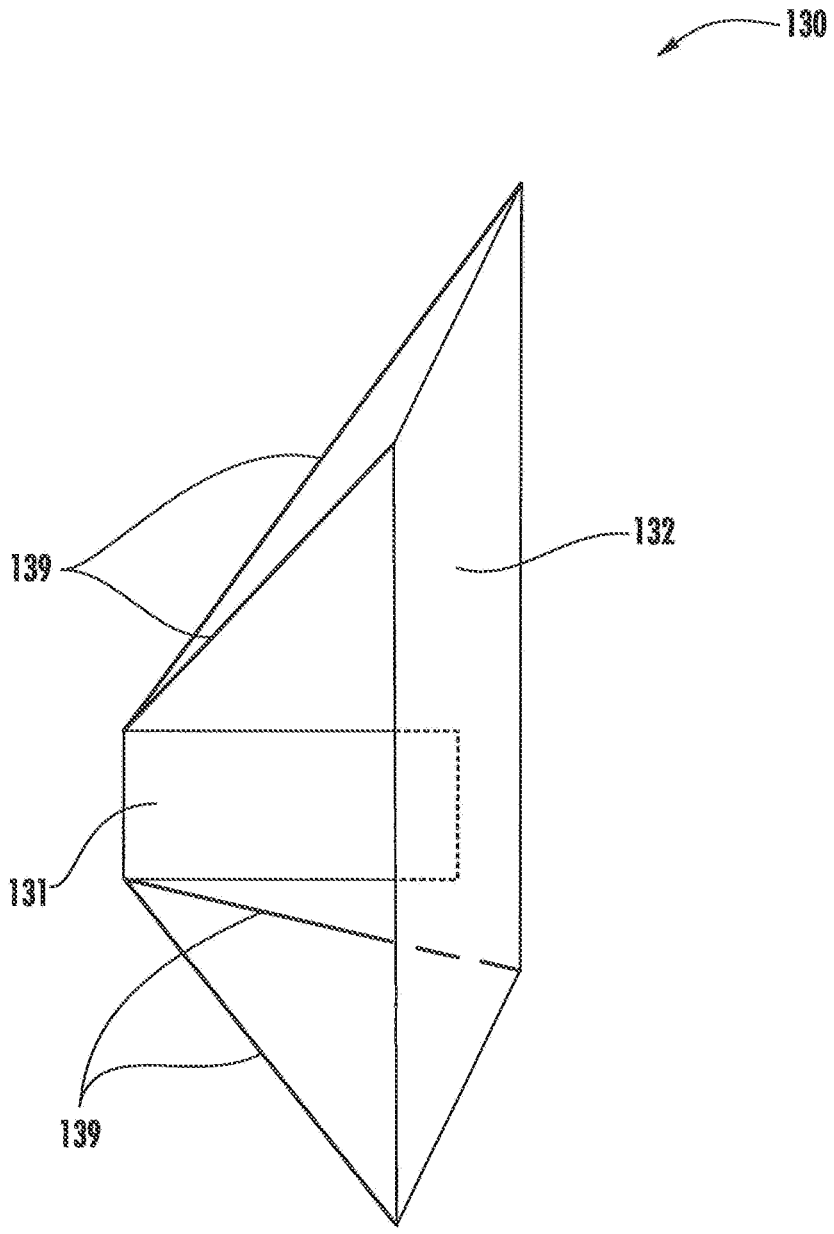

Having now described embodiments of the invention in general terms, reference will now be made to the accompanying drawings, where:

FIG. 1 depicts a side view rendering of a prototype for a boat motor assembly with a shroud assembly, in accordance with embodiments of the invention;

FIG. 2 depicts a side view rendering of a prototype for a boat motor assembly with a detachable shroud assembly, in accordance with embodiments of the invention;

FIG. 3 depicts a side view rendering of a prototype for a boat motor assembly with a shroud assembly, with the shroud being detachable from the shroud extension, in accordance with embodiments of the invention;

FIG. 4 depicts a side view rendering of a prototype for a boat motor assembly with a shroud assembly, the shroud partially extending over the length of the shroud extension, in accordance with embodiments of the invention;

FIG. 5 depicts a side view rendering of a prototype for a boat motor assembly with a shroud assembly, the shroud completely extending over the length of the shroud extension, in accordance with embodiments of the invention;

FIG. 6 depicts a side view rendering of a prototype for a boat motor assembly with a shroud assembly, the shroud extension partially enclosing the perimeter of the handle, in accordance with embodiments of the invention;

FIG. 7 photographically depicts a prototype for a shroud assembly, in accordance with embodiments of the invention;

FIG. 8 photographically depicts a prototype for a shroud assembly being grasped by a user, in accordance with embodiments of the invention;

FIG. 9 photographically depicts a boat motor assembly and a prototype for a shroud assembly, in accordance with embodiments of the invention;

FIG. 10 depicts a side view of a boat motor assembly and a prototype for a shroud with no shroud extension, in accordance with the embodiments of the invention;

FIG. 11 schematically illustrates a side view rendering of a prototype for a shroud assembly, wherein the shroud extension is capable of being rotatably coupled to the handle, in accordance with embodiments of the invention;

FIG. 12 schematically illustrates a side view rendering of a prototype for a shroud assembly capable of being retracted into a handle cavity, in accordance with embodiments of the invention;

FIG. 13 schematically illustrates a side view rendering of a prototype for a shroud assembly, wherein the shroud is capable of being collapsed on the surface defined by the shroud extension, in accordance with embodiments of the invention; and FIG. 14 schematically illustrates a side view rendering of a prototype for a shroud that is a planar surface, in accordance with embodiments of the invention.

DETAILED DESCRIPTION OF EMBODIMENTS OF THE INVENTION

Embodiments of the present invention now may be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

In one aspect, the present invention embraces a shroud assembly as an attachment for a boat motor assembly to help protect the user's hands from harsh weather conditions during operation.

A "user" as used herein may operate the present invention. The user may be defined as any person interacting with the present invention.

As used herein, a "vessel" may be described as a watercraft or structure, used or capable of being used as a means of transportation or habitation on the water. In some embodiments, a vessel may be a land vehicle. In some embodiments, a vessel may be an amphibious vehicle capable of transportation or habitation on both land and water.

As used herein, a "motorboat" may refer to a speedboat, powerboat, or any other type of boat powered by a boat motor assembly. In some embodiments, a boat motor may refer to an outboard motor, inboard motor, a stern drive motor, a jet drive motor, or the like. In some embodiments, the boat motor assembly may be permanently mounted or installed in the vessel. In some other embodiments, the boat motor assembly may be detachably mounted or installed in the vessel. A boat motor assembly, when mounted or installed in a vessel may render the vessel a motorboat for the duration of the installation. Vessels that qualify to be classified in this category may include canoes, inflatable vessels, dinghies and the like.

FIGS. 1 through 9 depict a boat motor assembly 100 in accordance with the present invention. The boat motor assembly 100 typically includes a boat motor 110, a handle 120, and a shroud assembly 130. Typically, a housing 116 serves as the body or the chassis of the boat motor 110, as shown in FIG. 9. Typically, the housing is manufactured from a stiff material, such as a metal, a metal alloy, a plastic, a plastic composite, carbon fiber, a ceramic, or the like. In some embodiments, the boat motor 110 may include an upper section 111, a middle section 112, and a lower section 113.

The upper section 111 (or the power-head) generally includes an engine that is used to power the vessel. In some embodiments, the engine may be a reciprocating engine, a diesel engine, a pulse jet engine, external combustion engine, or any other type of engine. In some other embodiments, the engine may refer to an internal combustion engine. In alternative embodiments the engine may refer to an external combustion engine. Typically, the engine is powered by energy-dense fuels such as gasoline, diesel, or liquid derived from fossil fuels. In some embodiments, the engine may be replaced by an electric motor, powered by direct current sources (e.g., batteries, rectifiers), or alternating current sources (e.g., inverters). Typically, the boat motor 110 uses an ignition system to ignite the fuel in the engine. In some embodiments, the boat motor 110 may use a mechanical ignition system. In some other embodiments, the boat motor 110 may use an electronic ignition system. In alternative embodiments, the boat motor 110 may use a distributorless ignition system. Typically, the upper section 111 includes a handle 120 for steering and a thrust lever attached to the handle 120 to regulate the speed of the engine. In some aspects, the handle 120 may refer to a wheel, a rudder, a helm, a tiller, or any other type of steering assembly.

Typically, the middle section 112 (or drive shaft housing) extends downward below the power-head. The drive shaft housing may include an exhaust system associated with the engine. The lower section 113 includes a transmission and houses a propulsion shaft that drives the propeller 114. In some embodiments, the lower section 113 may include a transmission to transfer power from the drive shaft to the propeller 114. Typically, the transmission is a forward/neutral/reverse type transmission. This type of transmission may enable the vessel to function in at least one of the forward/neutral/reverse operational states. Accordingly, the transmission may define the driving condition of the propeller 114. In some embodiments, the propeller 114 may be replaced by any other known or suitable propulsion device. For example, the propulsion device, without limitation, could be a jet pump unit.

In some embodiments, the boat motor assembly 110 may be coupled to the vessel using a clamp 115, a bolt, brackets, or the like as shown in FIGS. 1 through 9. In other embodiments, the boat motor assembly 100 may be coupled to the vessel using a combination of couplings. The construction of the boat motor 110 as thus far described may be considered to be conventional; therefore, further description of the boat motor 110 is not believed to be necessary. In typical embodiments, a user may grasp with his or her hand the handle 120 coupled to the boat motor assembly 100 to operate the boat motor (e.g., as depicted in FIG. 8). A thrust lever with a twist grip acceleration control may be attached with the handle 120 to not only steer the vessel but also to regulate the speed of the engine. The handle 120 typically defines a length, width, and perimeter. As depicted in FIGS. 1 through 9, the handle 120 may define a proximal portion 121 and a distal portion 122 relative to the boat motor 110. In some embodiments, the portion (e.g., the distal portion 122) of the handle 120 designated to be grasped by the user may include a textured surface to ensure a non-sliding grip throughout the operation. An example of a textured surface may include a rough coating on the handle 120 to avoid slipping on the hand during operation.

In some embodiments, the handle 120 may include grooves or grips 129 for the user's fingers to grasp the handle 120 as shown in FIG. 1.

When steering the vessel using the handle 120, the user may expose his or her hand to harsh weather conditions, including low temperatures, wind, rain, snow, sleet, ice, or the like for the entirety of the time that the user is operating the boat motor 110. If the user is not wearing gloves, mittens, or any other type of hand protection while operating the boat motor 110, the effects of the harsh weather conditions may be magnified. Accordingly, the boat motor assembly 100 typically includes a shroud assembly 130 for protecting the user's hand from harsh or extreme weather conditions when steering the vessel. For example, if the user is steering the vessel at high speeds during weather conditions with cold rain and strong wind, the user's hand grasping the handle 120 may be protected from harsh elements by a shroud (e.g., a protective shield) that breaks the wind and rain before they reach the user's hand.

In typical embodiments, the shroud assembly 130 is coupled to the handle 120 and includes a shroud extension 131 and a shroud 132. The shroud assembly 130 is typically coupled to the distal portion 122 of the handle 120 to protect the user's hand grasping the handle 120 from harsh elements such as wind, sleet, or ice, as shown in the FIG. 8. By way of example, the shroud extension 131 may be permanently coupled to the boat motor handle 120. Alternatively, the shroud extension 131 is detachably coupled to the boat motor handle 120 with a coupling. Examples of the coupling may include a clip, a latch, a threaded insert, a lid, a snapping connector, a welded seam, or the like. As displayed in FIG. 2, the handle 120 may include a clip 123 that corresponds with the cavity 124 of the shroud extension 131. To form a snap fit, the handle 120 may be pushed into the cavity 124 with sufficient force to mate the clip 123 of the handle 120 with the cavity 124 of the shroud extension. A sufficient pulling force may then be used to detach the shroud extension 131 from the handle 120. In another embodiment, the shroud extension 131 may be rotatably coupled to the handle 120, as depicted in FIG. 11. In this regard, the shroud extension 131 and the handle 120 are rotatable relative to each other about an axis of rotation.

Typically, the shroud extension 131 defines a length, a width, and a perimeter. In some embodiments, the width of the shroud extension 131 may be at least the width of the handle 120 as shown in FIGS. 1 through 10. In some other embodiments, the width of the shroud extension 131 may be less than the width of the handle 120, as shown in FIGS. 11 and 12. Typically, the shroud extension 131 fits completely around the perimeter of the handle 120. In some embodiments, the shroud extension 131 may fit partially around the perimeter of the handle 120 as shown in FIG. 6. In some other embodiments, the shroud extension 131 may include a cavity 131*a* perpendicular to the length of the shroud extension 131, as shown in FIGS. 7 through 9.

The shroud 132 is configured to protect the user's hand when grasping the handle 120 from harsh elements (e.g., by that disrupting wind and rain before they reach the user's hand). Accordingly, the shroud 132 defines a shape that is sufficient to protect the user's hand. For example, the shroud 132 may define a cone-like shape (e.g., as depicted in FIGS. 1 through 12). A shroud 132 having a cone-like shape may include a first perimeter 133 and a second perimeter 134 around the perimeter of the shroud extension 131, as displayed in FIGS. 1 through 11, in which the first perimeter 133 is greater than the second perimeter 134. By way of an alternative example, the shroud 132 may define a planar shape (e.g., a triangular, rectangular, hexagonal, polygonal, elliptical, or circular plane) as depicted in FIG. 14.

The shroud 132 typically defines a stiff surface. Accordingly, the shroud 132 may be formed from a rigid (e.g., stiff) material, such as a metal, a metal alloy, plastic, plastic composite, carbon fiber, ceramic, or the like. Alternatively, the shroud 132 may be formed from a flexible material (e.g., a flexible polymeric material) that is capable of blocking wind and protecting a user's hands from harsh weather conditions. In some embodiments, the shroud 132 may be formed from a flexible material that can be collapsed on the surface of the shroud extension 131 as depicted in FIG. 13.

The shroud 132 is typically coupled to the shroud extension 131. More typically, the shroud 132 is permanently coupled to the shroud extension 131 (e.g., as depicted in FIG. 1). As depicted in FIG. 14, the shroud 132 may be coupled to the shroud extension 131 via one or more rods 139, which may also serve to support the shroud 132.

Alternatively, the shroud 132 may be detachably coupled to the shroud extension 131. As depicted in FIG. 3, the shroud 132 may be coupled to the shroud extension 131 using clips 126. To form a snap fit, the shroud extension 131 may be pushed into a cavity 140 defined by the shroud 132 with sufficient force to mate the clip 126 of the shroud extension 131 with the cavity 140. A sufficient pulling force may then be used to detach the shroud 132 from the shroud extension 131.

The shroud 132 may be coupled to the shroud extension 131 so that the shroud 132 may partially surround the shroud extension 131 (e.g., partially extend along the length of shroud extension), as shown in FIG. 4. In some embodiments, the shroud 132 may fully extend along length of the shroud extension 131 with adequate space between proximal portion 121 of the handle 120 and the first perimeter 133 of the shroud 132 for user hand access, as shown in FIG. 5. Alternatively, the shroud 132 may not extend along the length of the shroud extension 131, as shown in FIGS. 1 and 2.

In an alternative embodiment, the shroud assembly 130 may lack a shroud extension as shown in FIG. 10. In such an alternative embodiment, the shroud 132 may be directly coupled to the distal portion 122 of the handle 120 thereby eliminating the need for a shroud extension 131.

In some embodiments, the shroud assembly 130 may be retractable. In this regard and as shown in FIG. 12 and FIG. 13, the handle 120 may include a cavity 150 into which the shroud assembly 130 may be retracted and stored when not in operation. As shown in FIG. 12, the length of the cavity 150 may be at least the length of the shroud extension 131. The shroud 132 may be manually collapsed on the extension 131 and retracted into the cavity 150. The shroud extension 131 may include a clip 136 that corresponds with a mate 137 in the cavity 150. To form a snap fit, the shroud assembly 130 may be pushed into the cavity 150 with sufficient force to lock the clip 136 of the shroud extension with the mate 137 in the cavity 150. In some embodiments, the shroud assembly 130 may be mechanized to collapse on the shroud extension 131 and retract into the cavity 150. For example, as shown in FIG. 13, the handle 120 may include a motor 138 to collapse the shroud 132 on the shroud extension 131 and thereafter retract the shroud extension 131 the into the cavity 150. The motor 138 may further operate to extend a retracted shroud extension 131 from the cavity 150 and thereafter expand a collapsed shroud 132.

While certain exemplary embodiments have been depicted and shown in the accompanying drawings, it is to be understood that such embodiments are merely illustrative and not restrictive on the broad invention, and that this invention not be limited to specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, or vice versa. In addition, where possible, any terms expressed in singular form herein are meant to also include the plural form and/or vice versa, unless explicitly stated otherwise. Accordingly, the terms "a" and/or "an" shall mean "one or more".

What is claimed is:

1. A boat motor handling assembly comprising:

a housing comprising a boat motor;

a handle extending between first and second handle ends, wherein the first handle end is connected to the boat motor and the second handle end extends at a length from the housing of the boat motor, wherein the handle is configured to be grasped by a user to rotate the boat motor; and a shroud assembly comprising:

a shroud extension comprising a body extending between first and second shroud extension ends, wherein the first shroud extension end is coupled proximate to the second handle end of the handle and extends at a length from the second handle end of the handle in a direction away from the housing; and a shroud comprising a body extending between first and second shroud ends, wherein the first shroud end is coupled adjacent to the second shroud extension end and the body of the shroud extends along the body of the shroud extension in a direction toward the first shroud extension end, wherein the second shroud end of the shroud is spaced apart from the housing of the boat motor by the shroud extension to allow access to the handle by the user at a position between the second shroud end of the shroud and the housing.

2. The assembly of claim 1, wherein the second handle end of the handle defines a width and first shroud extension end of the shroud extension defines a whole with a width of at least the width of the handle.

3. The assembly of claim 1, wherein the first shroud extension end is permanently coupled to the handle.

4. The assembly of claim 1, wherein the first shroud extension end is detachably coupled to the handle.

5. The assembly of claim 1, wherein the first shroud extension end is rotatably coupled to the handle.

6. The assembly of claim 1, wherein the body of the shroud is conic in shape extending from a first diameter at the first shroud end to a second diameter at the second shroud end.

7. The assembly of claim 6, wherein the first diameter is less than the second diameter.

8. The assembly of claim 1, wherein the shroud is permanently coupled to the shroud extension.

9. The assembly of claim 1, wherein the shroud is detachably coupled to the shroud extension.

10. The assembly of claim 1, wherein the shroud is retractable.

11. The assembly of claim 1, wherein the shroud assembly is retractable into a cavity defined by the handle.

12. The assembly of claim 11, wherein the shroud assembly is mechanized with a motor to retract into the cavity defined by the handle.

13. The assembly of claim 1, wherein the shroud is collapsible.

14. The assembly of claim 13, wherein the shroud is collapsible on the surface defined by the shroud extension.

15. The assembly of claim 14, wherein the shroud is mechanized with a motor to collapse on the surface of the shroud extension.

16. The assembly of claim 1, wherein the shroud defines a stiff surface formed from a rigid material.

17. The assembly of claim 1, wherein the shroud comprises a flexible surface formed from a flexible material.

18. A boat motor assembly comprising:

a boat motor;

a housing defining a cavity, wherein the boat motor is positioned in the cavity, wherein the housing has a handle extending between first and second handle ends, wherein the first handle end is connected to the boat motor and the second handle end extends at length from the housing of the boat motor, wherein the handle is configured to be grasped by a user to rotate the boat motor;

a shroud assembly comprising;

a shroud extension comprising a body extending between first and second shroud extension ends, wherein the first shroud extension end is detachably coupled proximate to the second handle end of the handle and extends at a length from the second handle end of the handle in a direction away from the housing; and a shroud comprising a body extending between first and second shroud ends, wherein the first shroud end is coupled adjacent to the second shroud extension end and the body of the shroud extends along the body of the shroud extension in a direction toward the first shroud extension end, wherein the second shroud end of the shroud is spaced apart from the housing of the boat motor by the shroud extension to allow access to the handle by the user at a position between the second shroud end of the shroud and the housing, wherein the shroud is conic in shape extending from a first diameter at the first shroud end to a second diameter at the second shroud end wherein the first diameter is less than the second diameter, the shroud defining a stiff surface formed from a rigid material.

19. A boat motor assembly comprising:

a boat motor;

a housing defining a cavity, wherein the boat motor is positioned in the cavity, wherein the housing comprises a handle comprising a body extending between first and second handle ends, wherein the first handle end is connected to the boat motor and the second handle end extends at a length in a direction away from the housing, the handle being configured to be grasped by a user to rotate the boat motor; and a shroud comprising a body extending between first and second shroud ends, wherein the first shroud end is coupled adjacent to the second handle end located in a direction away from the boat motor and the body of the shroud extends along the body of the handle in a direction toward the first handle end and toward the boat motor, wherein the second shroud end of the shroud is spaced apart from the housing of the boat motor to allow access to the handle by the user at a position between the second shroud end of the shroud and the housing, wherein the shroud is conic in shape extending from a first diameter at the first shroud end to a second diameter at the second shroud end wherein the first diameter is less than the second diameter, the shroud defining a stiff surface formed from a rigid material.

* * * * *